US008109503B2

(12) United States Patent
Shirasaki et al.

(10) Patent No.: US 8,109,503 B2
(45) Date of Patent: Feb. 7, 2012

(54) CONNECTION MECHANISM, AND PAPER FEEDING UNIT AND IMAGE FORMING APPARATUS EQUIPPED WITH CONNECTION MECHANISM

(75) Inventors: Seiichi Shirasaki, Osaka (JP); Masahiko Miyazaki, Kyoto (JP)

(73) Assignee: Kyocera Mita Corporation (JP)

( * ) Notice: Subject to any disclaimer, the term of this patent is extended or adjusted under 35 U.S.C. 154(b) by 50 days.

(21) Appl. No.: 12/486,047

(22) Filed: Jun. 17, 2009

(65) Prior Publication Data

US 2009/0315254 A1 Dec. 24, 2009

(30) Foreign Application Priority Data

Jun. 18, 2008 (JP) ..... P2008-158897

(51) Int. Cl.
*B65H 1/00* (2006.01)

(52) U.S. Cl. ..... 271/162; 24/684

(58) Field of Classification Search ..... 271/162, 271/163, 146; 24/297, 453, 684; 403/326, 403/329

See application file for complete search history.

(56) References Cited

U.S. PATENT DOCUMENTS 6,848,685 B2 * 2/2005 Katsuyama ..... 271/162
7,203,445 B2 * 4/2007 Uchida ..... 399/107

FOREIGN PATENT DOCUMENTS

JP 05-142871 6/1993

* cited by examiner

*Primary Examiner* — Michael McCullough
(74) *Attorney, Agent, or Firm* — Ostrolenk Faber LLP

(57) ABSTRACT

A connection mechanism connecting a sheet feeding unit, supplying a paper to an image forming apparatus, with the image forming apparatus or other sheet feeding unit, the connection mechanism comprising: a connection member disposed on a frame of the sheet feeding unit and rotatably supported on the frame; and an engaging member disposed on the image forming apparatus or the frame of the other sheet feeding unit, wherein: the connection member is rotated between an engaging position where the connection member engages with the engagement member and a retracting position where the connection member disengages with the engaging member and retracts from the engaging position.

8 Claims, 9 Drawing Sheets

CONNECTION MECHANISM, AND PAPER FEEDING UNIT AND IMAGE FORMING APPARATUS EQUIPPED WITH CONNECTION MECHANISM

The present application claims priority on Japanese Patent Application No. 2008-158897, filed Jun. 18, 2008, the content of which is incorporated herein by reference.

BACKGROUND OF THE INVENTION

1. Field of the Invention

The present invention relates to a sheet feeding unit that can be connected in series to a main body of an image forming apparatus via a connection mechanism. The image forming apparatus includes a sheet feeding unit. Examples of the image forming apparatus include a copying machine, a printer, and a facsimile machine.

2. Description of the Related Art

According to a image forming apparatus that includes a sheet feeding unit that can be connected in series to the main body of the image forming apparatus, merely fixing the positions of the sheet feeding unit and the printer P, such as the main body of the image forming apparatus or other sheet feeding units, makes it difficult to maintain physical stability when the image forming devices receive an impact by, for example, being pushed or struck from the front, back, right, or left. As a result, the image forming apparatus might be damaged because the connection may be detached and the image forming apparatus may fall over. Consequently, it is necessary to restrict any detachment or separation between the paper feeding unit and the printer P by setting up a connection mechanism between the paper feeding unit and the printer P.

In order to attain a level of safety regarding such image forming devices, safety guidelines such as UL, CSA, and IEC are established for testing how the image forming apparatus is knocked down.

Japanese Unexamined Patent Application, First Publication No. H5-142871 (hereinafter referred to as Patent Document 1) discloses a mechanism for fixing and connecting a copying machine. According to this fixing and connecting mechanism, a connecting device used to fix positions is set up in a lower section of the main body of the copying machine. In addition, the fixing and connecting mechanism forms a positioning fixture that fixes and connects a positioning connecting tool to the printer P. Further, this fixing and connecting mechanism matches a screw hole formed on the above connecting tool and the above fixing tool. Thus, the fixing and connecting mechanism is structured to bind and fix the connecting tool and the fixing tool using bolts and the like.

However, the connection mechanism recited in Patent Document 1 is structured to screw objects together using bolts and the like. Thus, even though a desired level of physical stability is attained, tools are needed to connect or disconnect objects. As a result, it is burdensome to use the connection mechanism, and the connection mechanism cannot be operated easily.

Considering the problems described above, the present invention aims to provide a sheet feeding unit and an image forming apparatus including a connection mechanism that is physically stable, easy to operate, and can easily establish connection between the sheet feeding unit and the printer P.

SUMMARY OF THE INVENTION

In order to achieve the above object, the present invention employs the following.

Namely, a connection mechanism connecting a sheet feeding unit, supplying a paper to an image forming apparatus, with the image forming apparatus or other sheet feeding unit, the connection mechanism including: a connection member disposed on a frame of the sheet feeding unit and rotatably supported on the frame; and an engaging member disposed on the image forming apparatus or the frame of the other sheet feeding unit, wherein: the connection member is rotated between an engaging position where the connection member engages with the engagement member and a retracted position where the connection member disengages from the engaging member and retracts from the engaging position.

In addition, the connection member is disposed on an upper part of the frame of the sheet feeding unit; and the engaging unit is disposed on a lower part of the image forming apparatus or a lower part of the frame of the other sheet feeding unit.

In addition, the connection mechanism according to the aspect of the present invention may be configured as follows: when the connection member is located at the connecting position, a part of the connection member protrudes outside from an upper part of the frame, and when the connection member is located at the retracted position, the connection member is stored within the frame.

In addition, the connection mechanism according to the aspect of the present invention may be configured as follows: the connection member includes a click portion protruding in a direction of a rotation center thereof, and the engaging member includes an engaging portion protruding to and engaged with the click portion in the connecting position.

On the other hand, a sheet feeding unit supplies a paper in an image forming apparatus, the sheet feeding unit having a connection mechanism connecting the sheet feeding unit with the image forming apparatus or other sheet feeding unit, the sheet feeding unit comprising: a frame; and a connection mechanism including a connection member and an engaging member, the connection member disposed and rotatably supported on the frame, the engaging member disposed on the image forming apparatus or the frame of the other sheet feeding unit, wherein: the connection member is rotated between an engaging position where the connection member engages with the engagement member and a retracted position where the connection member disengages from the engaging member and retracts from the engaging position.

In addition, the sheet feeding unit according to the aspect of the present invention may be configured as follows: the frame is shaped approximately as a rectangle in planar view; a plurality of connection mechanisms are disposed along a short side of the frame; and a connection member of each of the above connection mechanisms is disposed so that an axis of the turning coincides approximately with the direction of the short side.

In addition, the sheet feeding unit according to the aspect of the present invention may be configured as follows: a plurality of the above connection mechanisms are included on both ends of the short side.

In addition, the sheet feeding unit according to the aspect of the present invention may be configured as follows: the connection member is located on a side of the frame that is lower in a weight distribution while the sheet feeding unit is connected to the image forming apparatus or the other sheet feeding unit.

In addition, the sheet feeding unit according to the aspect of the present invention may be configured as follows: the frame includes a cassette insertion slot for inserting a sheet feeding cassette therein; and the connection mechanism is located on an inner wall of the frame in a side opposite to a side where the cassette insertion slot is formed.

In addition, the sheet feeding unit according to the aspect of the present invention may be configured as follows: the connection member has a different color from the inner wall.

Based on the sheet feeding unit according to the aspect of the present invention described above, it is possible to provide a paper supplying unit and an image forming apparatus that are physically stable, easy to operate, and can be easily connected together.

On the other hand, an image forming apparatus includes the sheet feeding unit described above.

The above object as well as other objects of the present invention and the present invention's characteristics and advantages will become clearer from the appended figures and the detailed description below.

DETAILED DESCRIPTION OF THE PREFERRED EMBODIMENTS

Figure 1:
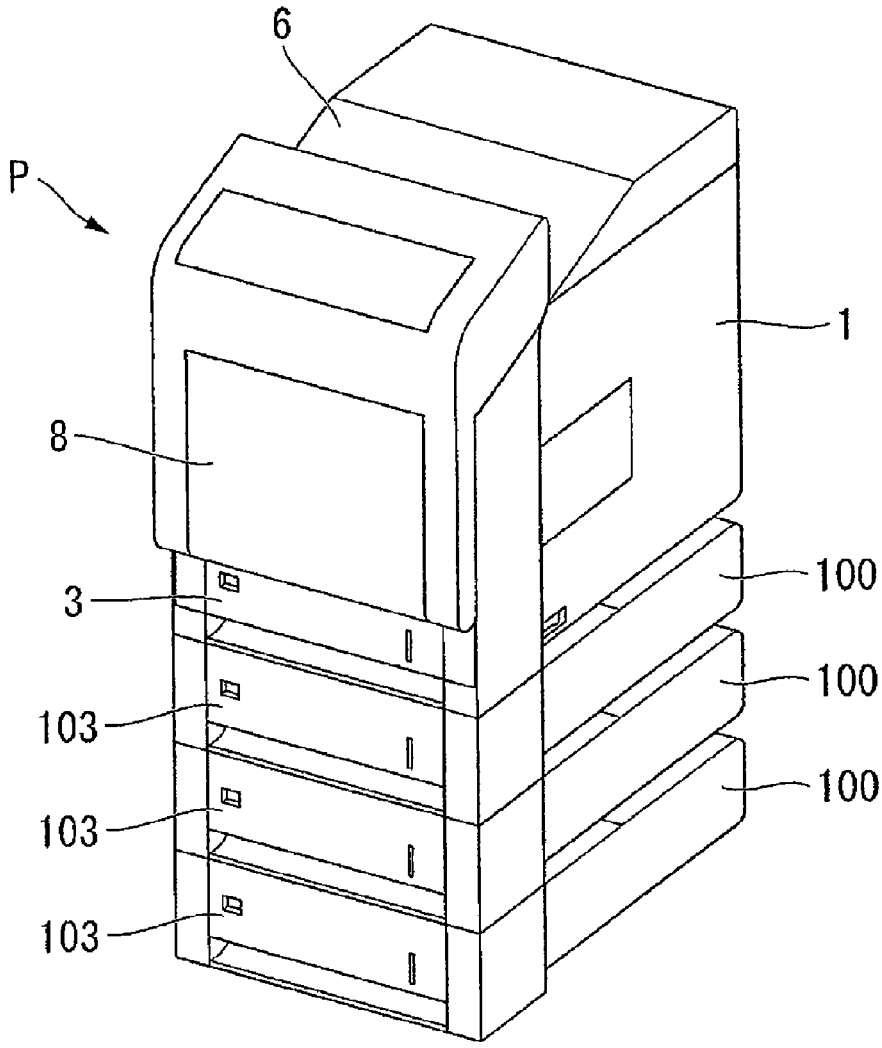
FIG. 1 is a perspective view showing a printer according to an embodiment of the present invention.

An embodiment of a sheet feeding unit and an image forming apparatus according to the present invention is described with reference to the drawings. The description below concerns an aspect of the present invention being applied to a printer (an image forming apparatus). Each unit shown in the drawings is expanded or contracted, as necessary, so that each unit can be large enough to be visible.

First, a configuration of a printer P according to the present embodiment is described with reference to FIGS. 1 and 2.

FIG. 1 is a perspective view showing a printer P according to the present embodiment.

Figure 2:
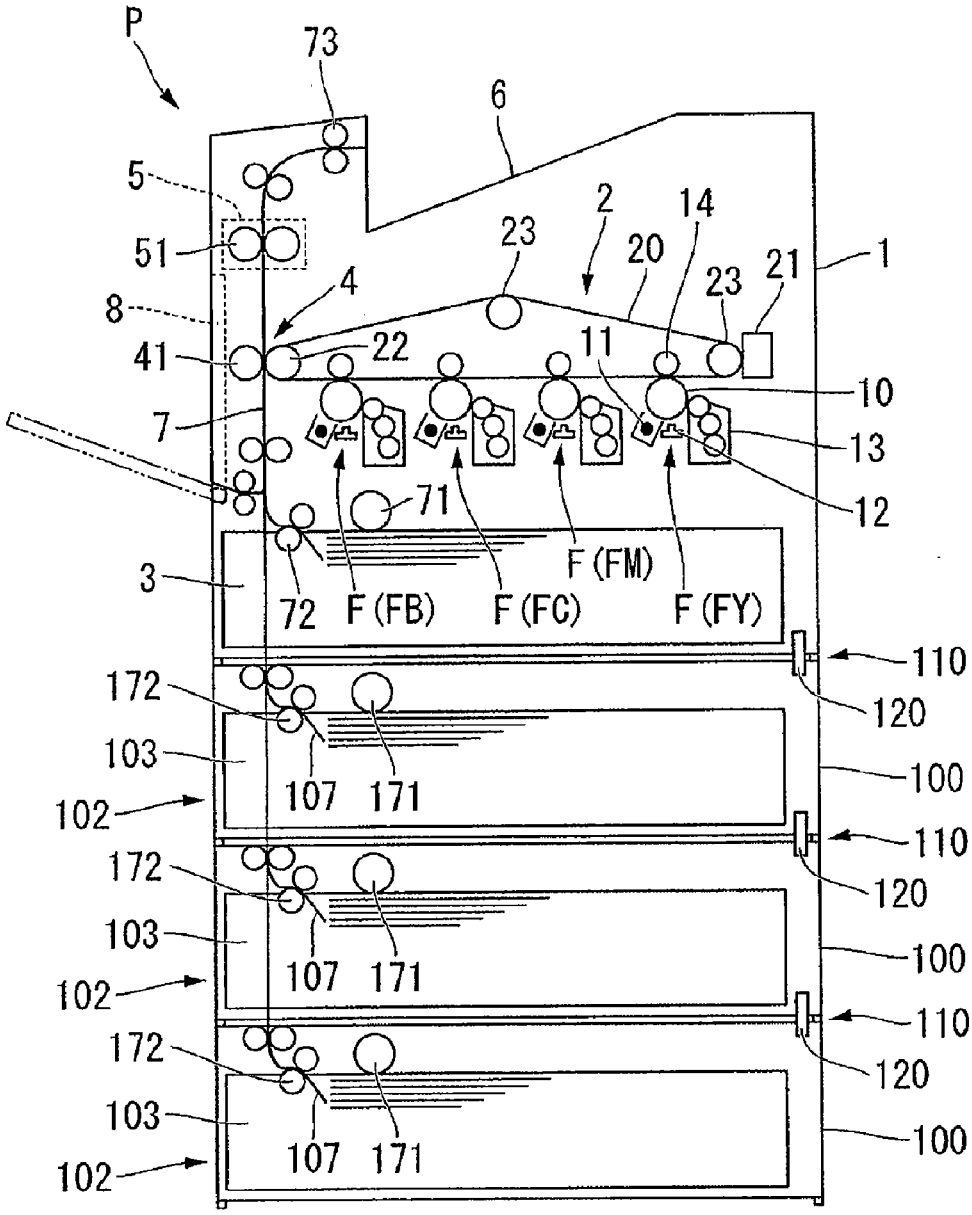
FIG. 2 is a rough diagram showing a configuration of a printer according to the above embodiment of the present invention.

FIG. 2 is a rough diagram showing a configuration of a printer P according to the above embodiment.

As shown in FIG. 1, printer P includes a plurality of paper feeding units 100 that can be connected in series to the main body of the image forming apparatus 1. The printer P according to the present embodiment is equipped with three paper feeding units 100 which are stacked on top of one another. The main body of the image forming apparatus 1 is placed on top of the three paper feeding units. The paper feeding unit 100 is configured as an optional unit so that the number of the paper feeding units can be increased to a desired amount.

As shown in FIG. 2, the main body of the image forming apparatus 1 includes an image forming section 2 which forms an image on a recording medium, a paper feeding cassette 3 which stores the recording medium, a secondary transfer section 4 which transfers the image formed by the image forming section 2 to the recording medium, a fixing unit 5 which fixes the copied image to the recording medium, a discharge tray 6 which stacks the recording mediums that are ejected after the fixing of the image was completed, and a conveying path 7 which conveys the recording medium from the paper feeding cassette 3 to the catch tray 6. Further, the main body of the image forming apparatus 1 includes a manual tray 8 which can be pulled open and closed. Consequently, the main body of the image forming apparatus 1 is configured so that a carrying path from the manual tray 8 can be joined into the carrying path 7.

The image forming section 2 includes an intermediate transfer belt 20, a cleaning unit 21 which cleans the intermediate transfer belt 20, and image forming units F (FY, FM, FC, and FB) which correspond respectively to colors yellow (Y), magenta (M), cyan (C), and black (BK).

The intermediate transfer belt 20 is wrapped around a driving roller 22 and a tension roller 23. In addition, the intermediate transfer belt 20 runs clockwise in FIG. 2.

The cleaning unit 21 includes, for example, a cleaning roller and a cleaning blade, and the like. In addition, the cleaning unit 21 removes toners, and the like, which were left in the intermediate transfer belt 20.

The image forming unit F includes a photoconductor 10, a charging device 11, an exposure device 12, a development device 13, and a primary transfer roller 14. Further, the image forming unit F includes, for example, a cleaning device and a erase device, and the like (not diagramed).

The photoconductor 10 is formed as a cylinder. An electrostatic latent image and a toner image based on the electrostatic latent image are formed on a circumferential surface of the photoconductor 10. The charging device 11 is located to face the photoconductor 10. The charging device 11 charges the circumferential surface of the photoconductor 10. The exposure device 12 scans a laser beam which is generated based on image data in a printable format on the circumferential surface of the photoconductor 10 in an electrically charged state.

The development device 13 develops the electrostatic latent image on the circumferential surface of the photoconductor 10 by supplying toner. The primary transfer roller 14 is located so that the primary transfer roller 14 faces the photoconductor 10, with the intermediate transfer belt 20 located between the primary transfer roller 14 and the photoconductor 10. In addition, the primary transfer roller 14 primarily transfers the image, developed on the photoconductor 10, onto the intermediate transfer belt 20.

The paper feeding cassette 3 can be pulled out from the main body of the image forming apparatus 1. Furthermore, the paper feeding cassette 3 holds the recording medium.

The secondary copying unit 4 secondarily copies the image, formed on the intermediate transfer belt 20, onto the recording medium. In addition, the secondary copying unit 4 includes a driving roller 22 which drives the intermediate transfer belt 20 and a secondary copying roller 41 which is placed facing the driving roller 22, with the intermediate transfer belt 20 located between the driving roller 22 and the copying roller 41.

The fixing unit 5 fixes images which were secondarily transferred onto the recording medium. In addition, the fixing unit 5 includes a heating roller 51 which fixes a toner by applying pressure and heat.

The conveying path 7 includes, for example, a pickup roller 71 placed on the paper feeding cassette 3, the pickup roller 71 carrying a recording medium from the paper feeding cassette 3, a paper feeding roller 72 which carries the recording medium, and an ejection roller 73 which ejects the recording medium onto the catch tray 6.

The paper feeding unit 100 is an optional unit which can be detached from the main body of the image forming apparatus 1 configured as described above. This paper feeding unit 100 can be connected to the main body of the image forming apparatus 1 or another paper feeding unit 100 via a connection mechanism 110 (described later).

Figure 3:
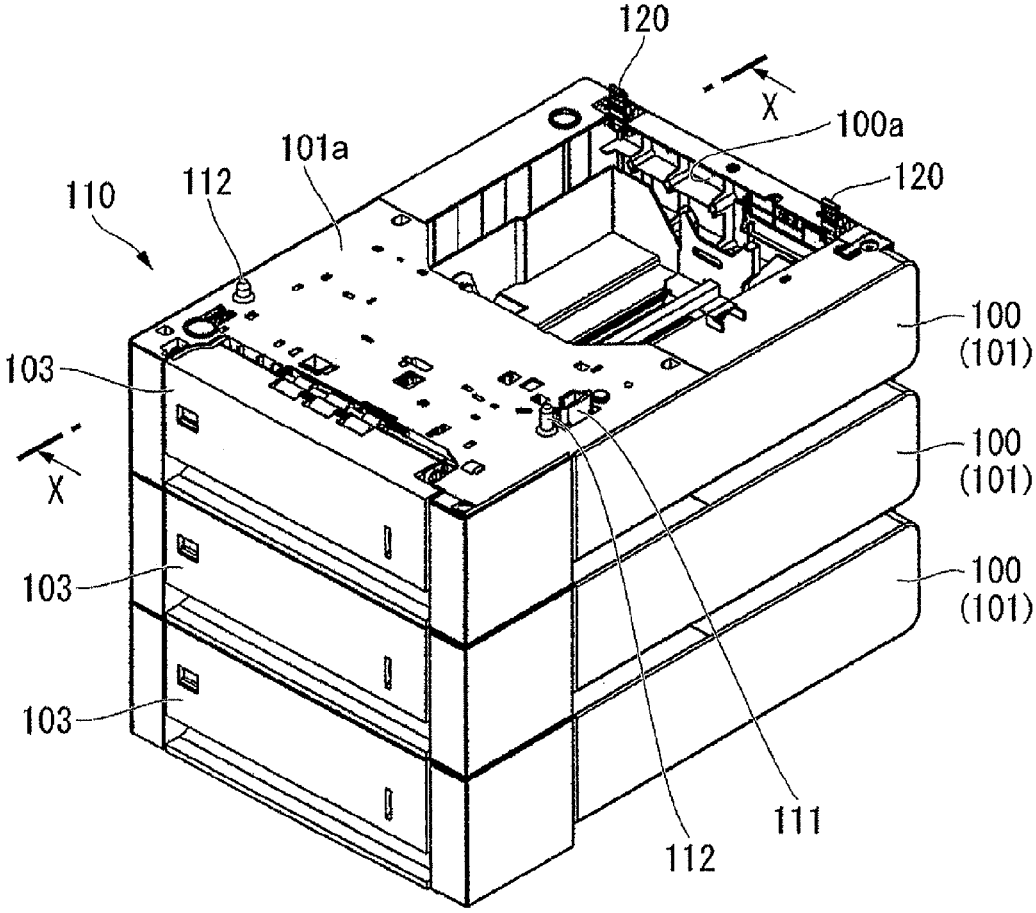
FIG. 3 is a perspective view of a sheet feeding unit showing a configuration of a connection mechanism according to the above embodiment of the present invention when a main body of an image forming apparatus is removed.

The paper feeding unit 100 is shaped substantially as a rectangular box in planar view (refer to FIG. 3). The paper feeding unit 100 includes a frame 101 which is shaped like a box, a paper feeding cassette 103 which stacks recording mediums and can be inserted to and removed from the frame 101, a feeding path 107 which connects the paper feeding cassette 103 and the carrying path 7 of the main body of the image forming apparatus 1. The bottom surface (not diagramed) of the frame 101 is not closed by a bottom plate but opened.

The paper feeding unit 100 (frame 101) includes a cassette loading slot 102 which opens toward the front side. The paper feeding cassette 103 can be pulled out via the cassette loading slot 102, and can be detached as well.

The unit feeding path 107 provided in the frame 101 includes, for example, a pickup roller 171 that feeds out a recording medium from the paper feeding cassette 103 and a paper feeding roller 172 which feeds the recording medium.

According to the printer P as configured above, the weight distribution deviates toward the front side (the side where the manual tray 8 is placed) where a number of devices and rollers and the like are placed as shown in FIG. 2.

Next, a configuration of the connection mechanism 110 is described with reference to FIGS. 3 to 10.

As shown in FIG. 3, the paper feeding unit 100 (frame 101) includes a connector 111 which electrically connects the paper feeding unit 100 with a connected object such as the image forming apparatus, printer P, or other paper feeding units, a positioning pin 112 which positions the connected object, which is placed on top of the paper feeding unit 100, to a desired location, and a connection mechanism 110 which connects and disconnects the paper feeding unit 100 and the connected object.

The connector 111 and the positioning pin 112 are provided on a ceiling plate 101*a* which forms a ceiling of the front side of the frame 101 of the paper feeding unit 100. The positioning pin 112 is placed respectively on both ends of the paper feeding unit 100 (frame 101) in the direction of the shorter side. One of the positioning pins 112 is placed near the connector 111.

A plurality of the connection mechanisms 110 are located along a short side of the back side of the paper feeding unit 100 (frame 101). In other words, the connection mechanism 110 is located on the back side in which there is a lower weight distribution of the printer P supported by the paper feeding unit 100. Further, two connection mechanisms 110 according to the present embodiment are placed on both ends of the short side. One connection mechanism 110 is placed on each end of the short side.

Figure 4:
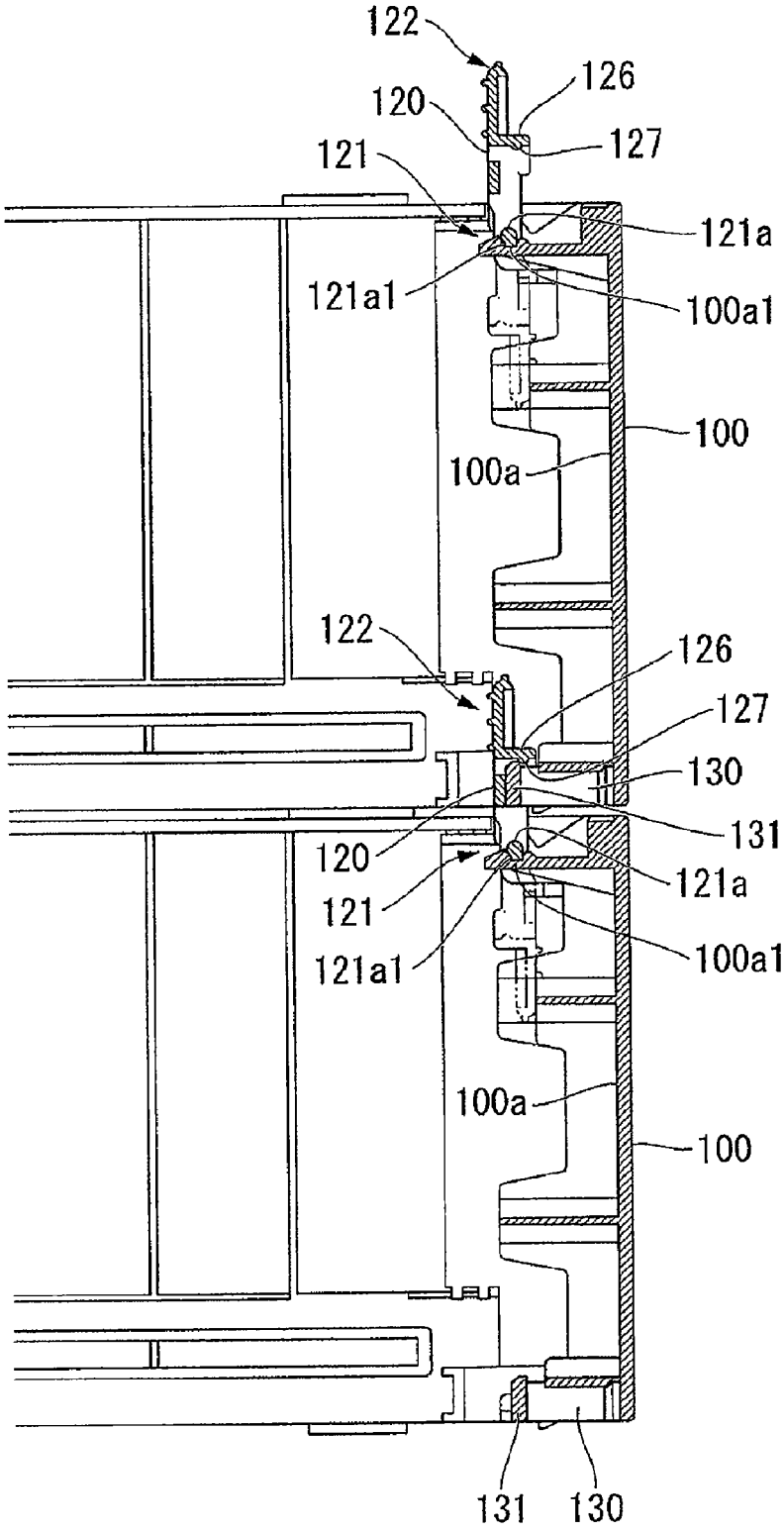
FIG. 4 is a cross sectional view in the X-X plane of FIG. 3 showing a configuration of a connection mechanism according to the above embodiment of the present invention.

The connection mechanism 110 includes a connection member 120 and an engaging member 130. As shown in FIG. 4, the connection member 120 is placed so that a basal portion 121, which is located on an inner wall 100*a* of the paper feeding unit 100 (frame 101), can turn freely. Further, as shown in FIG. 4, the connection member 120 is placed so that the rotation axis 121*a* of the basal portion 121 is approximately along in the direction of a short side. The connection member 120 is configured so as to turn freely around the rotational axis 121*a* of the basal portion 121.

According to a configuration of the present embodiment, the tip portion 122 can move freely between a connecting position (shown in a solid line in FIG. 4) and a disconnected position (shown in a dotted line in FIG. 4). A connection of the paper feeding unit 100 and the printer P is made at the connecting position. A disconnected position is 180 degrees rotated from the connecting position. Connection is disconnected at the disconnected position.

Figure 6:
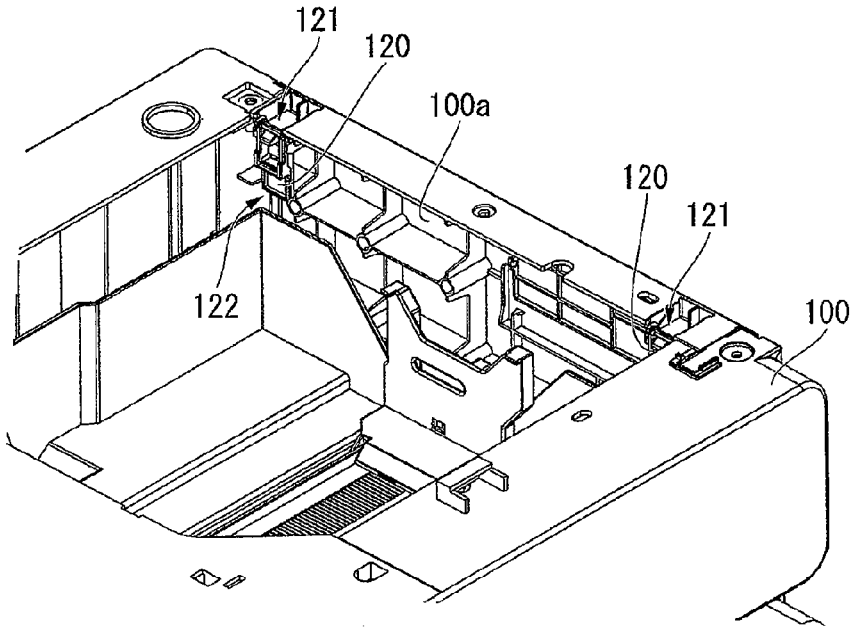
FIG. 6 is a perspective view showing a connection member according to the above embodiment of the present invention when the connection member is in a disconnected position.
Figure 8:
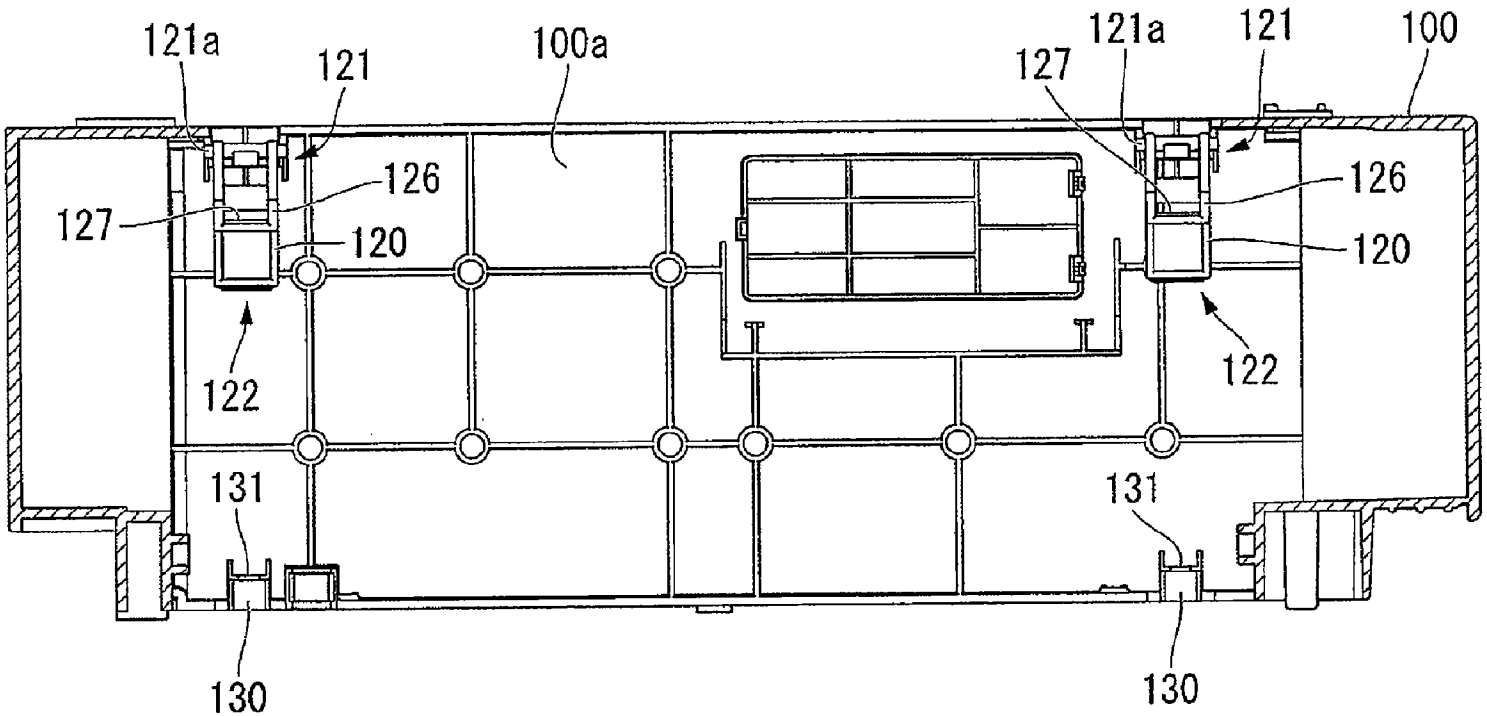
FIG. 8 is a front view showing a connection member according to the above embodiment of the present invention when the connection member is in a disconnected position.

When the tip portion 122 is located at the disconnected position, the connection member 120 is put in the paper feeding unit 100 (frame 101) as shown in FIGS. 6 and 8. As a result, it is possible to prevent the connection member 120 from being a contributing factor to damage such as unexpected impact from the outside that occurs when the connection member is not used to connect devices, for example, the paper feeding unit 100 is packaged or transported.

Figure 5:
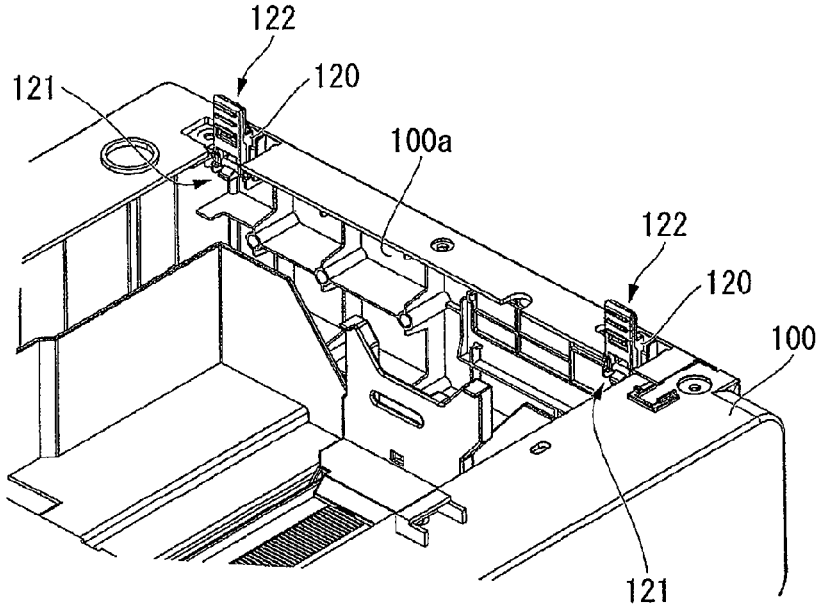
FIG. 5 is a perspective view showing a connection member according to the above embodiment of the present invention when the connection member is in a connecting position.
Figure 7:
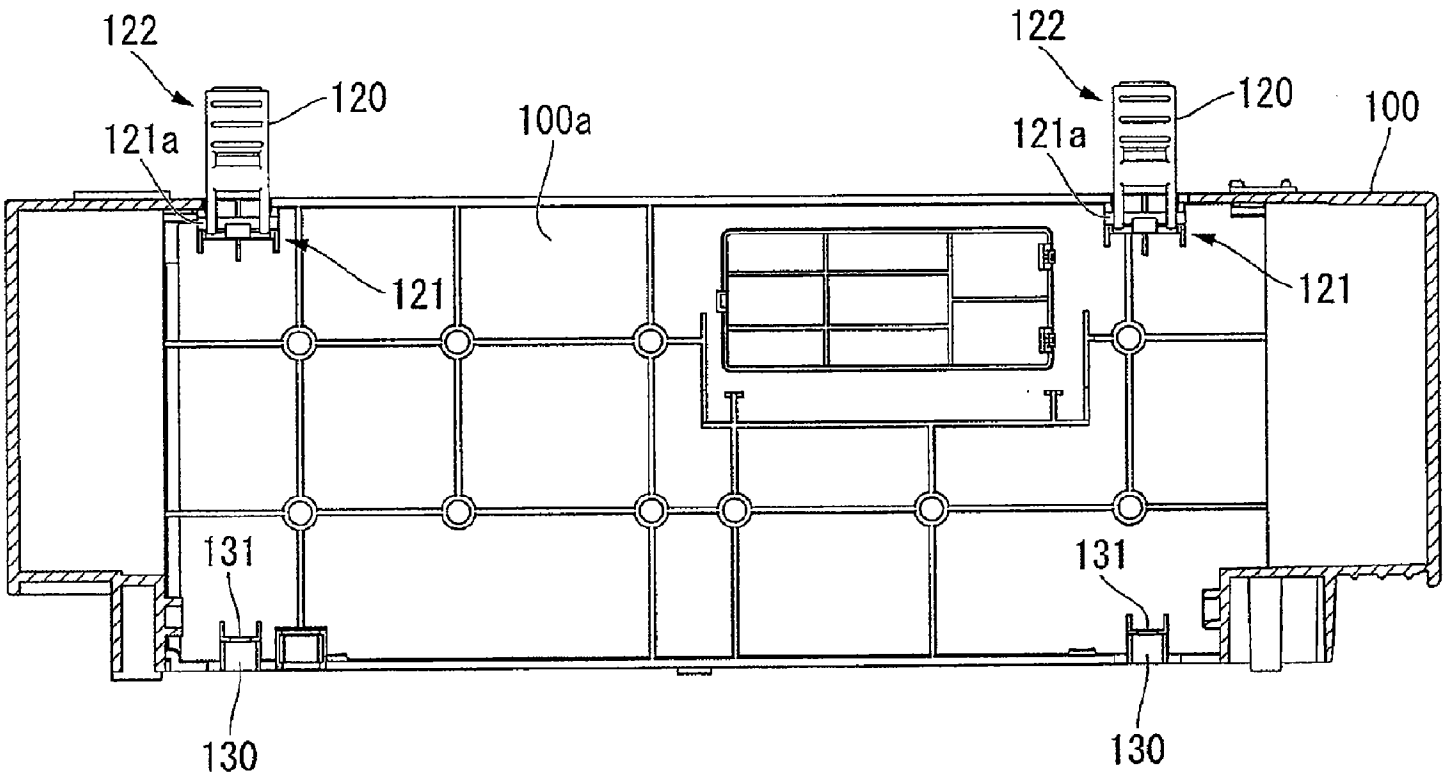
FIG. 7 is a front view showing a connection member according to the above embodiment of the present invention when the connection member is in a connecting position.

Meanwhile, when the tip portion 122 is located at the connecting position, the connection member 120 is located in a perpendicular state such that the tip portion 122 protrudes above the paper feeding unit 100 (frame 101) as shown in FIGS. 5 and 7. At this time, the connection member 120 engages with the engaging member 130 which is located on the bottom part of the printer P shown in FIG. 4.

Figure 9:
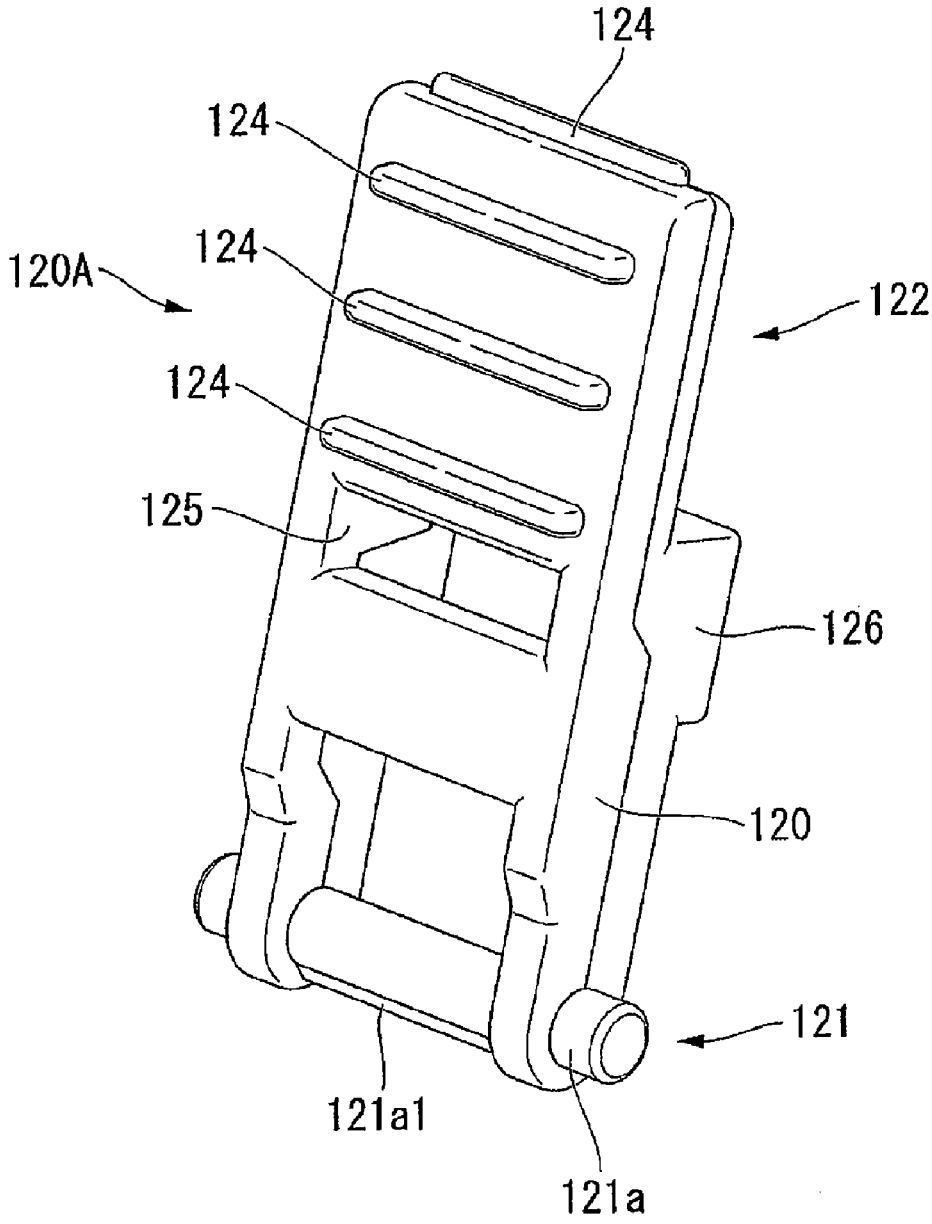
FIG. 9 is a perspective view showing a configuration of a back side of a connection member according to the above embodiment of the present invention.

Regarding the back side 120A of the connection member 120 shown in FIG. 9, three convex portions 124 are formed parallel to each other on the connection member 120. Each of the three convex portions 124 is elongated in the width direction of the connection member 120. Furthermore, one convex portion 124 is formed on the end of the tip portion 122 of the connection member 120. Further, a transfixing slot 125 is formed perpendicular to the back side 120A and closer to the basal portion 121 than the convex portions 124.

Figure 10:
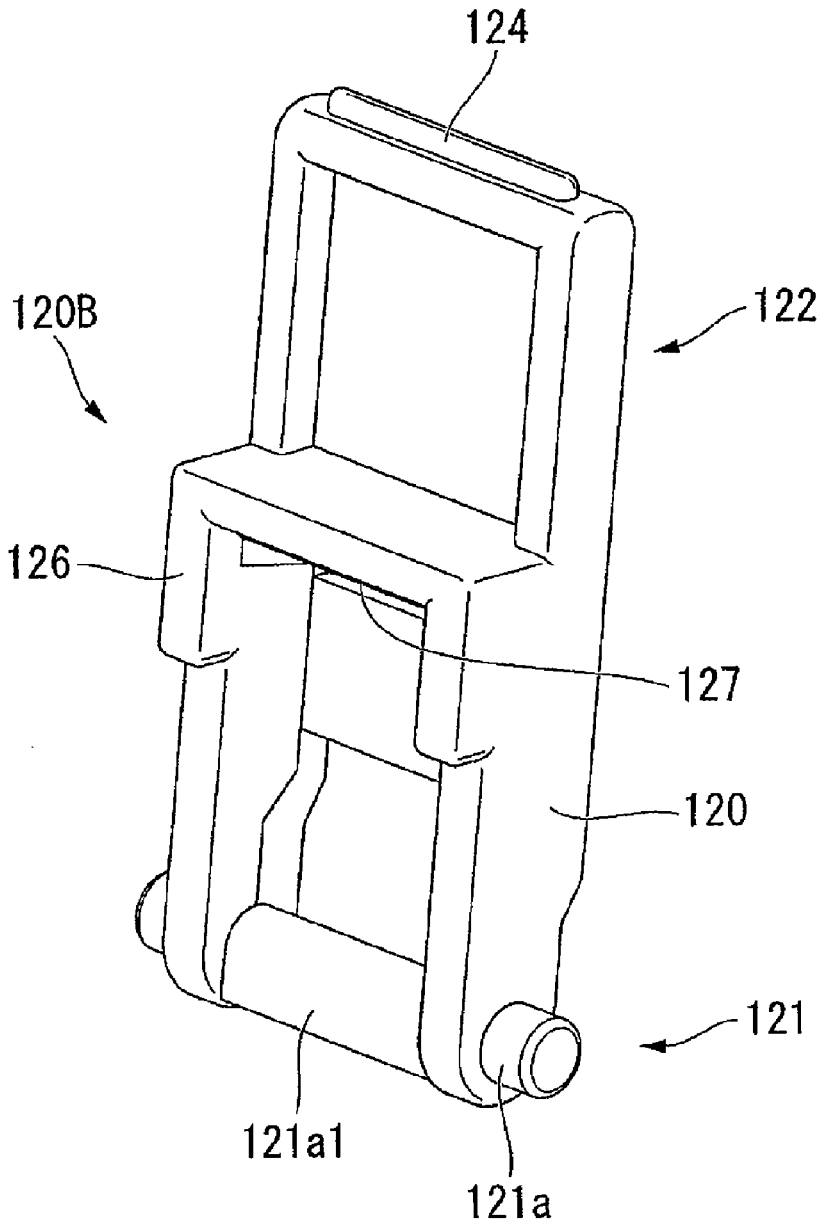
FIG. 10 is a perspective view showing a configuration of a frontal side of a connection member according to the above embodiment of the present invention.

Regarding the front side 120B of the connection member 120 shown in FIG. 10, a holding portion 126 is formed on the connection member 120. The holding portion 126 protrudes toward the engaging member 130 in the connecting position. The holding portion 126 is formed according to the shape of the engaging member 130. Further, a click portion 127 is provided on the connection member 120. The click portion 127 protrudes in the direction of the radius of the turning excursion. The holding portion 126 is shaped so that the holding portion 126 holds the engaging unit 130. Described in more detail, when the holding portion 126 engages with the engaging unit 130, the holding portion 126 encompasses three sides that include both sides of the engaging unit 130 in the direction of the short side and an upper side.

In addition, as shown in FIGS. 4, 9, and 10, a D-cut plane 121*a*1 is formed in the center portion of the rotational axis 121*a* of the basal portion 121 of the connection member 120. According to this configuration, when the connection member 120 is located at the connecting position, the D-cut plane 121*a*1 is in contact with the horizontal surface of the supporting unit 100*a*1.

The connection member 120 as described above is shaded yellow while the paper feeding unit 100 (frame 101) and the inner wall 100*a* of the paper feeding unit 100 (frame 101) is shaded gray.

On the other hand, the engaging member 130 is formed on the printer P so that the engaging member 130 protrudes towards the inner side from the inner wall 100*a*. In addition, as shown in FIG. 4, the engaging unit 130 protrudes in the path through which the click unit 127 passes as the connection member 120 turns. When the connection member 120 is located in the connecting position, an engaging portion 131 is formed. The engaging protruding portion 131 engages with the click unit 127 in the direction in which the engaging unit 130 turns as the engaging unit 130 moves towards the disengaging position.

Next, the connecting and disconnecting operations of the connection mechanism 110, configured as above, are described.

First, the user makes sure that the connection member 120 is located at the disconnected position. Then, the user places the printer P above the paper feeding unit 100. At this time, the user places the printer P so that the printer P matches the connector 111 and the positioning pin 112 shown in FIG. 3.

Next, the user pulls out and takes out the paper feeding cassette 103 equipped in the paper feeding unit 100 (frame 101). The user then sticks his or her hand through the cassette insertion slot 102 placed on the paper feeding unit 100 (frame 101), and accesses the connection member 120 which is placed in the back section (refer to FIGS. 2 and 3). At this time, through the cassette insertion slot 102, the user sees the connection member 120 placed in a dim section within the paper feeding unit 100 (frame 101). The user can visibly recognize the connection member 120 because the connection member 120 is placed along the direction in which the user looks through the cassette insertion unit 102, and because the connection member 120 is shaded in a color different from the color of the inner wall 100*a*.

When the user connects multiple paper feeding units 100 to each other, the user may take out the paper feeding cassette 103 shown in FIG. 3, and access the connection member 120 by placing his or her hand from above through an opening on the back side with respect to the ceiling plate 101*a* placed on the front side of the paper feeding unit 100 (frame 101).

Then, the user wraps his or her finger around the bump 124 formed on the connection member 120. Next, the user holds the tip portion 122. The user then rotates the connection member 120, which is placed in the disconnected position, up by 180 degrees. Further, the user moves the connection member 120 to the connecting position shown in FIG. 4. The user thus connects the paper feeding unit 100 to the printer P.

At this time, a resistance, caused when the engaging protruding portion 131 undergoes an elastic deformation as the clicking unit 127 comes in contact with the engaging protruding portion 131 and, and an impact, caused when the resistance is released as the click unit 127 moves beyond the engaging protruding portion 131, inform the user that a connection was made properly. Further, the click unit 127 engages with the engaging protruding portion 131. This configuration restricts the connection member 120, located in the connecting position, from turning towards the direction of the disconnected position. At this time, the D-cut surface 121*a*1 comes in contact with the horizontal surface of the supporting unit 100*a*1. Consequently, the restriction of the turning, described above, becomes more reliable.

As shown in FIG. 2, the printer P, connected as described above, has a heavier weight distribution in its front side (the left side of FIG. 2). As a result, the printer P is less likely to detach or fall down due to a pushing or an impact from the front side towards the back side (the right side of FIG. 2). Regarding a pushing or an impact from the back side towards the front side, the printer P is less likely to detach or fall down because the connection member 120 is placed in the back side which has a lighter weight distribution.

Further, the printer P is shaped substantially as a rectangle in planar view. As a result, the printer P is more likely to detach or fall down due to a pushing or an impact applied in the direction of the short side compared to the direction of the long side. However, the connection member 120 is placed in both ends of the short side as shown in FIG. 3. Thus, a separation between a long side of the paper feeding unit 100 (frame 101) and the long side of the printer P is prevented because the connection member 120 appropriately receives, near these long sides, a moment by which the long side of the paper feeding unit 100 (frame 101) and the long side of the printer P may be separated. The moment described above is caused by a pushing or an impact in the direction of the short side. Furthermore, the rotational axis 121*a* is placed so that the axis line coincides with the direction of the short side. Consequently, the direction in which the moment is applied is perpendicular to the direction in which the connection member 120 turns. As a result, it is possible to prevent the connecting unit 120 from moving to the disconnected position due to the application of the above moment.

When the user disconnects the printer P which is connected as described above, the user first pulls out the paper feeding cassette 103 loaded in the paper feeding unit 100 (frame 101). Next, the user inserts his or her hand through the cassette insertion slot 102 placed in the paper feeding unit 100 (frame 101) and accesses the connection member 120 located in the back side. Further, the user turns the connection member 120 from the connecting position to the disconnected position.

In addition, when the user releases the connection between the paper feeding unit 100 and another paper feeding unit, the user may take out the paper feeding cassette 103, and access the connection member 120 by placing his or her hand from above through an opening on the back side with respect to ceiling plate 101*a* placed on the front side of the paper feeding unit 100 (frame 101).

Thus, according to the present embodiment described above, a paper feeding unit, which supplies paper to an image forming apparatus and can be connected above and below, comprises: a frame; a paper feeding cassette which loads paper and can be inserted and pulled out from the frame; and a connection mechanism including a connection member and an engaging unit, wherein: the connection member can turn around a rotational axis placed in a rear anchor unit; the engaging unit is fixed to the frame; the connection mechanism is placed in the frame and can connect the image forming apparatus with the paper feeding unit, disconnect the image forming apparatus from the paper feeding unit, connect the paper feeding units to one another, and disconnect the paper feeding units from one another; the connection member of one of the paper feeding units can turn between a connection position, at which the connection member connects with the engaging unit of another paper feeding unit, and a disconnected position, at which disconnection is performed. According to the above configuration, the connection member 120, located on the paper feeding unit 100, turns. As a result, it is possible to connect and disconnect the paper feeding unit 100 and the printer P. Thus, tools are not necessary in order to connect and disconnect the devices. Consequently, the devices are easier to operate.

Therefore, the present embodiment is capable of providing a connection mechanism 110 of the printer P which can easily connect the paper feeding unit 100 and the printer P. The connection mechanism 110 is also physically stable and can be operated easily.

Further, according to the present embodiment, the connection member 120 is configured to be held within the paper feeding unit 100 (frame 101) when the connection member 120 is placed in the disconnected position. Because of this configuration, the connection member 120 will not be in the way when the paper feeding unit 100 is packaged and the like. Further, it is possible to prevent the connection member 120 from being damaged while being transported after the packaging.

Further, according to the present embodiment, a click unit 127 is placed on the tip portion 122 of the connection member 120. The click unit 127 protrudes in the direction of the radius of the turning described above. The click unit 127 sticks out to the printer P along the transportation path through which the click unit 127 passes during the turning described above. At the same time, an engaging protruding portion 131 is equipped so that the engaging protruding portion 131 engages with the click unit 127 in the direction in which the connection member 120, located in the disconnected position, turns in order to reach the above connecting position. According to this configuration, when the connection member 120 is turned to the connecting position, a resistance, caused when the clicking unit 127 comes in contact with the engaging protruding portion 131, and an impact, caused when the click unit 127 moves beyond the engaging protruding portion 131, informs the user that a connection was made properly. Further, the click unit 127 engages with the engaging portion 131. This configuration restricts the connection member 120, located in the connecting position, from turning towards the direction of the disconnected position. As a result, the paper feeding unit 100 and the printer P are more reliably prevented from separating from each other and the like.

Transmitting an impact to the user as described above is effective in reliably engaging the connection member 120 placed in a dimmed area.

According to the present embodiment, the paper feeding unit 100 (frame 101) is shaped approximately as a rectangle from a planar view. Multiple connection members 120 are placed along the short side of the above rectangular form. In addition, multiple connection members 120 are placed so that the rotational axis 121*a* roughly coincides with the direction of the short side. According to this configuration, it is possible to prevent the paper feeding unit 100 and the printer P from separating in the direction of the short side. The paper feeding unit 100 and the printer P are likely to become disconnected particularly in the direction of the short side when the paper feeding unit 100 is shaped approximately as a rectangle from a planar view.

Further, according to the present embodiment, the connection member 120 is located on both ends of the short side. Because of this configuration, the connection member 120 appropriately receives a moment when a pressing force and the like is applied from one side of the short side or the other. The moment operates to separate the paper feeding unit 100 and the printer P. The moment is caused by the pressing force and the like described above. As a result, it is possible to prevent the paper feeding unit 100 and the printer P from separating and the like.

Further, according to the present embodiment, the connection member 120 is located on a section of the printer P, supported by the paper feeding unit 100, which has a lower weight distribution. Because of this configuration, it is possible to prevent the paper supplying unit 100 and the printer P from separating and the like towards the side in which there is a lower weight distribution. The paper supplying unit 100 and the printer P are likely to separate from one another towards the side in which there is a lower weight distribution when a pushing force and the like is applied.

Further, according to the present embodiment, a cassette insertion slot 102 is formed on the paper supplying unit 100 (frame 101). A paper supplying cassette 103 can be inserted to the paper supplying unit 100 (frame 101) via the cassette insertion slot 102. In addition, the connection member 120 is located on the inner wall 100*a* of the paper supplying unit 100 (frame 101) on the side that faces the section on which the cassette insertion slot 102 is formed. Because of this configuration, it is possible to view the connection member 120 from the cassette insertion slot 102. At the same time, a user can access the connection member 120 via the cassette insertion slot 102. Consequently, the device becomes easy to operate.

Further, according to the present embodiment, the connection member 120 is located on the inner wall 100*a*. As a result, it is possible to prevent the user from viewing or accessing the connection member 120 from outside the device. Consequently, it is possible to prevent the user from inadvertently disconnecting the connection member 120. At the same time, the aesthetic design of the device is maintained.

Further, according to the present embodiment, the connection member 120 is shaded in a different color compared to the inner wall 100*a*. Because of this configuration, it is possible to prevent the visibility of the connection member 120 from decreasing due to being placed in a dimmed area within the paper supplying unit 100. Further, it is possible to distinguish the connection member 120 from the inner wall 100*a*.

While a preferred embodiment of the present invention has been described above, it should be understood that these are exemplary of the invention and are not to be considered as limiting the present invention. Additions, omissions, substitutions, and other modifications can be made without departing from the spirit or scope of the present invention.

For example, it was explained above that the connection member 120 according to the present embodiment is shaded yellow, which is a color different from that of the inner wall 100*a*. However, the present invention is not limited to this configuration. For instance, the connection member 120 may be coated with fluorescent paint which glows in the dark. The connection member 120 may also be coated with gold or silver and the like, which easily reflect light.

The invention is not to be considered as being limited by the foregoing description, and is only limited by the scope of the appended claims.

What is claimed is:

1. A connection mechanism connecting a sheet feeding unit to an image forming apparatus or to a further sheet feeding unit, for supplying paper to the image forming apparatus or to the further sheet feeding unit, the connection mechanism comprising:

a connection member disposed on a frame of the sheet feeding unit and rotatably supported on the frame; and an engaging member disposed on the image forming apparatus or on a frame of the further sheet feeding unit, wherein:

the connection member is rotatable around a rotational axis between an engaging position where the connection member engages with the engaging member and a retracted position where the connection member disengages from the engaging member and retracts from the engaging position;

the connection member is disposed on an upper part of the frame of the sheet feeding unit;

the engaging member is disposed on a lower part of the image forming apparatus or on a lower part of the frame of the further sheet feeding unit;

when the connection member is located at the engaging position, a part of the connection member protrudes outside from an upper part of the frame of the sheet feeding unit, and when the connection member is located at the retracted position, the connection member is stored within the frame of the sheet feeding unit; and while a sheet feeding cassette in the sheet feeding unit is pulled out, the connection member is movable to the engaging position or to the retracted position by rotating an end part of the connection member, distanced from the rotational axis, from inside the frame of the sheet feeding unit.

2. A connection mechanism according to claim 1, wherein:

the connection member includes a click portion protruding in a direction of a rotation center thereof, and the engaging member includes an engaging portion protruding to and engaged with the click portion in the engaging position.

3. A combination of a sheet feeding unit, a further sheet feeding unit, and an image forming apparatus, the sheet feeding unit supplying paper to the image forming apparatus, the sheet feeding unit being connectable to the image forming apparatus and to the further sheet feeding unit, the combination comprising:

a frame of the sheet feeding unit;

at least one connection member disposed and rotatably supported on the frame of the sheet feeding unit; and at least one first engaging member disposed on the frame of the sheet feeding unit, wherein:

each of the at least one connection member is rotatable around a rotational axis between an engaging position where each of the at least one connection member engages with a second respective engaging member, disposed on the image forming apparatus or on a frame of the further sheet feeding unit, and a retracted position where each of the at least one connection member disengages from the respective second engaging member and retracts from the engaging position, the frame of the sheet feeding unit includes a cassette insertion slot into which a sheet feeding cassette is inserted, and each of the at least one connection member is rotatable to the engaging position or to the retracted position from an inner wall side of the frame of the sheet feeding unit while a sheet feeding cassette in the sheet feeding unit is pulled out.

4. A combination of a sheet feeding unit, a further sheet feeding unit, and an image forming apparatus, according to claim 3, wherein:

the frame of the sheet feeding unit is shaped approximately as a rectangle in planar view, the at least one connection member comprises a plurality of connection members, the plurality of connection members are disposed along a short side of the frame of the sheet feeding unit, each one of the plurality of connection members being rotatably supported on the frame of the sheet feeding unit, the at least one first engaging member comprises a plurality of first engaging members, a plurality of second engaging members are disposed on the image forming apparatus or on the frame of the further sheet feeding unit, and each of the plurality of connection members is disposed so that an axis of a turning coincides approximately with a direction of the short side.

5. A combination of a sheet feeding unit, a further sheet feeding unit, and an image forming apparatus, according to claim 3, wherein:

the frame of the sheet feeding unit is shaped approximately as a rectangle in planar view, the at least one connection member comprises a plurality of connection members, the plurality of connection members being disposed along a short side of the frame of the sheet feeding unit, and the plurality of connection members are provided on both ends of the short side of the frame of the sheet feeding unit.

6. A combination of a sheet feeding unit, a further sheet feeding unit, and an image forming apparatus, according to claim 3, wherein the at least one connection member is located on a side of the frame of the sheet feeding unit that is lower in a weight distribution, while the sheet feeding unit is connected to the image forming apparatus or to the further sheet feeding unit.

7. A combination of a sheet feeding unit, a further sheet feeding unit, and an image forming apparatus, according to claim 3, wherein the at least one connection member has a different color from the inner wall side of the frame of the sheet feeding unit.

8. A combination of a sheet feeding unit, a further sheet feeding unit, and an image forming apparatus, the sheet feeding unit supplying paper to the image forming apparatus, the sheet feeding unit being connectable to the image forming apparatus and to the further sheet feeding unit, the combination comprising:

a frame of the sheet feeding unit;

at least one connection member disposed and rotatably supported on the frame of the sheet feeding unit; and at least one first engaging member disposed on the frame of the sheet feeding unit, wherein:

each of the at least one connection member is rotatable around a rotational axis between an engaging position where each of the at least one connection member engages with a second respective engaging member, disposed on the image forming apparatus or on a frame of the further sheet feeding unit, and a retracted position where each of the at least one connection member disengages from the respective second engaging member and retracts from the engaging position, each of the at least one connection member being configured so as to turn freely around the rotational axis, the frame of the sheet feeding unit includes a cassette insertion slot into which a sheet feeding cassette is inserted, and each of the at least one connection member is rotatable to the engaging position or to the retracted position from an inner wall side of the frame of the sheet feeding unit.

* * * * *